US008567934B2

(12) United States Patent
Hays

(10) Patent No.: US 8,567,934 B2
(45) Date of Patent: Oct. 29, 2013

(54) MULTI-PLANE FILTER LAMINATE TO INCREASE FILTRATION SURFACE AREA

(75) Inventor: Andrew W. Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 148 days.

(21) Appl. No.: 13/087,269

(22) Filed: Apr. 14, 2011

(65) Prior Publication Data

US 2012/0262522 A1 Oct. 18, 2012

(51) Int. Cl.
*B41J 2/175* (2006.01)

(52) U.S. Cl.
USPC ..... 347/93

(58) Field of Classification Search
USPC ..... 347/93
See application file for complete search history.

(56) References Cited

U.S. PATENT DOCUMENTS 5,489,930 A * 2/1996 Anderson ..... 347/71
6,139,674 A * 10/2000 Markham et al. ..... 156/252
6,234,623 B1 * 5/2001 Drake ..... 347/93
7,275,817 B2 * 10/2007 Clark et al. ..... 347/93
7,465,032 B2 * 12/2008 Silverbrook ..... 347/57
7,766,463 B2 8/2010 Stephens et al.
7,891,798 B2 * 2/2011 Andrews et al. ..... 347/93
2008/0002080 A1 1/2008 Kim et al.
2010/0045738 A1 * 2/2010 Stephens et al. ..... 347/44
2010/0263791 A1 10/2010 Stephens et al.

FOREIGN PATENT DOCUMENTS

EP 1336487 * 2/2003

* cited by examiner

*Primary Examiner* — Matthew Luu
*Assistant Examiner* — Michael Konczal
(74) *Attorney, Agent, or Firm* — MH2 Technology Law Group LLP

(57) ABSTRACT

A printhead including a jetstack configured to include a multi-plane filter laminate. The multi-plane filter laminate includes a first rock screen subassembly and a second rock screen subassembly. Each subassembly is configured to include an upstream pocket layer, a downstream pocket layer aligned with the upstream pocket layer, and a rock screen plate sandwiched between the upstream and downstream pocket layers, the rock screen plate configured with through holes over an entire exposed surface area thereof. A portion of the rock screen plate of the first subassembly is configured to overlay the rock screen plate of the second subassembly.

17 Claims, 4 Drawing Sheets

MULTI-PLANE FILTER LAMINATE TO INCREASE FILTRATION SURFACE AREA

DESCRIPTION OF THE INVENTION

1. Field of the Invention

This invention relates generally to imaging and, more particularly, to a multi-plane laminated filter structure in an imaging print head.

2. Background of the Invention

Currently, piezoelectric printheads use a thin film rock screen (also known as a particulate filter) to protect a jetstack from contamination. Relatively smaller rock screen holes can protect the jets better than relatively larger rock screen holes but result in a rock screen having higher fluidic resistance. Each jet is allocated a fraction of the rock screen area and the maximum pressure drop across the rock screen at full flow is defined by jetting requirements. The rock screen hole size therefore can be limited by the allocated area and the pressure drop requirement can require holes larger than desired from a contamination perspective. The hole size and pressure drop requirements limit the utility of the rock screen and increases the likelihood of customer print quality defects, i.e. intermittent, weak and missing jets.

The disadvantages of the thin film rock screen can be overcome and the effectiveness of the rock screen area can be increased according to exemplary embodiments herein by implementation of multiple rock screen planes or subassemblies so that the area allocated to a jet can increase.

SUMMARY OF THE INVENTION

According to various embodiments, the present teachings include a printhead. The printhead can include a jetstack configured to include a multi-plane filter laminate. The multi-plane filter laminate can include a first rock screen subassembly configured to include an upstream pocket layer, a downstream pocket layer aligned with the upstream pocket layer, and a rock screen plate sandwiched between the upstream and downstream pocket layers, the rock screen plate configured with through holes over an entire exposed surface area thereof. The multi-plate filter laminate can include a second rock screen subassembly bonded to the first rock screen subassembly and configured to include an upstream pocket layer, a downstream pocket layer aligned with the upstream pocket layer, and a rock screen plate sandwiched between the upstream and downstream pocket layers, the rock screen plate configured with through holes over an entire exposed surface area thereof. A portion of the rock screen plate of the first subassembly overlays the rock screen plate of the second subassembly.

According to various embodiments, the present teachings include a laminated rock screen structure for a liquid ink print head. The rock screen structure can include a first rock screen subassembly configured to include an upstream pocket layer, a downstream pocket layer aligned with the upstream pocket layer, and a rock screen plate sandwiched between the upstream and downstream pocket layers, the rock screen plate configured with through holes over an entire exposed surface area thereof. A second rock subassembly is bonded to the first rock screen subassembly and configured to include an upstream pocket layer, a downstream pocket layer aligned with the upstream pocket layer, and a rock screen plate sandwiched between the upstream and downstream pocket layers, the rock screen plate configured with through holes over an entire exposed surface area thereof. A portion of the rock screen plate of the first subassembly is laterally offset from and overlaying the rock screen plate of the second subassembly.

According to various embodiments, the present teachings include a printhead stack for a liquid ink printer. The printhead stack includes a manifold assembly, the manifold assembly comprising a multi-plane filter laminate; a heater assembly; an actuator assembly; and an aperture plate, wherein the printhead stack is configured to filter ink at the multi-plane filter laminate and dispense filtered ink at the aperture plate.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

It should be noted that some details of the figures have been simplified and are drawn to facilitate understanding of the inventive embodiments rather than to maintain strict structural accuracy, detail, and scale.

DESCRIPTION OF THE EMBODIMENTS

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

Figure 1:
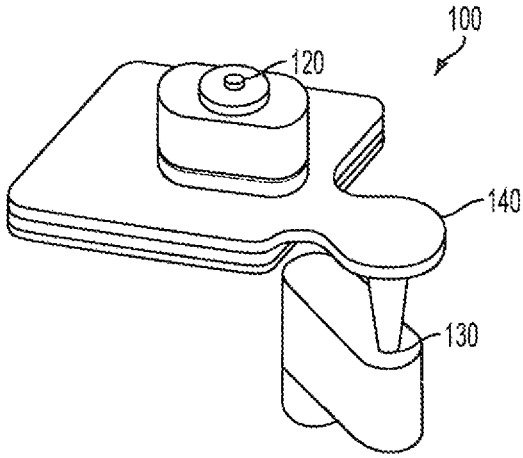
FIG. 1 is a perspective view of a high density piezoelectric actuator for an ink supply apparatus in accordance with the present teachings.

Direct marking actuators, for example piezoelectric inkjet devices, are typically designed with small features, on the order of 10's of microns in some areas. Specifically, an aperture is typically one of the narrowest areas in the fluid path and a likely place for contamination to collect. This causes jets to drop out, sputter or become permanently clogged, leading to dissatisfaction by the customer. Contamination build-up at any point in the fluid path can also cause print quality defects. An exemplary high-density piezoelectric actuator 100 is shown in FIG. 1. Certain fluid passage areas of the actuator can contain constrictions which can slow the fluid flow through the actuator. Constrictions can include an aperture 120, a laser drilled inlet 130, and a fluid path (not shown in FIG. 1) in a body plate 140 intermediate the aperture 120 and laser drilled inlet 130. Because of these potential constrictions, the exemplary embodiments herein include the multi-plane laminated filter structure upstream of the potential constrictions, as will be further described in the following.

Figure 2:
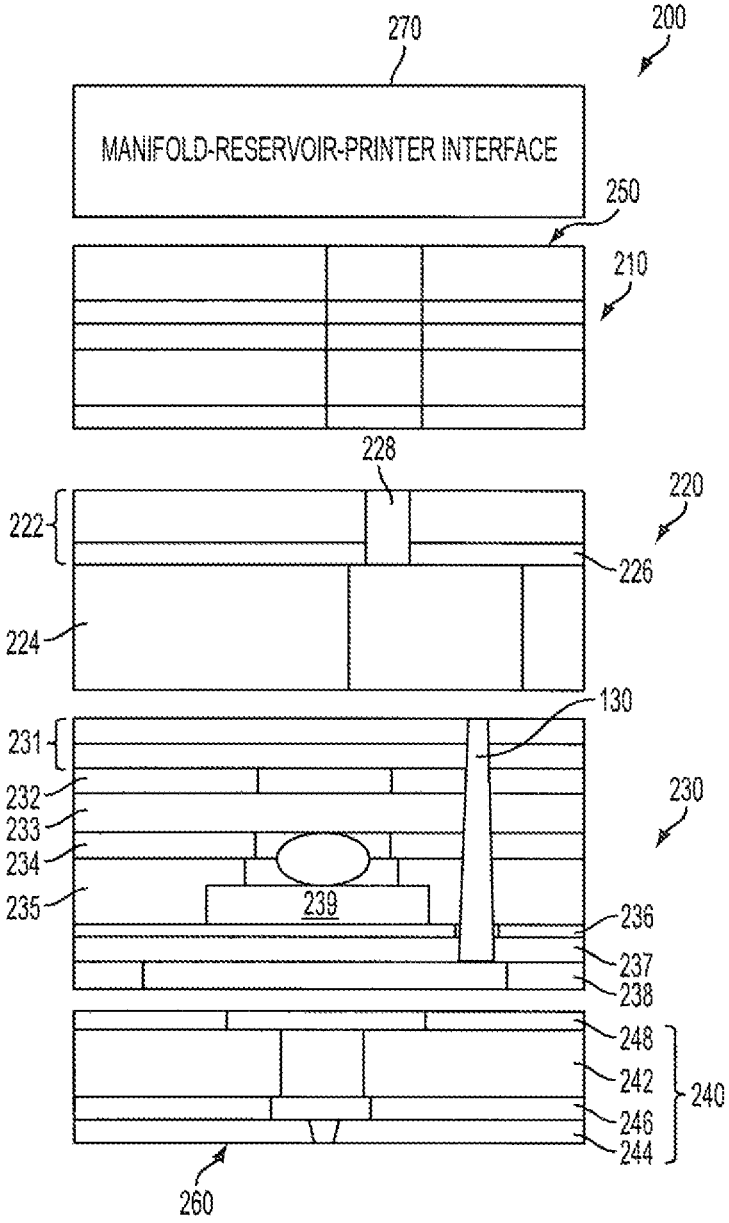
FIG. 2 is a schematic view of a jetstack, for use with the actuator of FIG. 1, in accordance with the present teachings.

FIG. 2 is a schematic view of a jet stack 200 for the actuator 100 of FIG. 1. It should be readily apparent to one of ordinary skill in the art that the jetstack 200 depicted in FIG. 2 represents a generalized schematic illustration and that other components can be added or existing components can be removed or modified.

The jetstack 200 can include a rock screen section 210, a heater section 220, an actuator section 230, and an ink feed plate section 240 at a fluid outlet side 260 of the jetstack 200. A manifold reservoir printer interface 250 can be configured at the fluid inlet side 270 of the jetstack 200.

The rock screen section 210 can include a multi-plane filter laminate as will be further described in connection with FIG. 4 in the following.

The heater section 220 can include an offset inlet layer 222 and a heater layer 224. The offset inlet layer 222 can include a polyimide having a thickness of about 3 mil. The heater layer 224 can include a polyimide having a thickness of about 7 mil. The offset inlet layer 222 and the heater layer 224 can be bonded together by an adhesive layer 226. An offset inlet 228 can be formed in the offset inlet layer.

The actuator section 230 can include multiple layers as known in the art; including a heater attach layer 231, a flex spacer 232, a flex layer 233, a standoff layer 234, a polymer layer 235, a diaphragm 236, and a body plate 238, listed in order from the inlet side 270 toward the outlet side 260 of the jetstack 200. The diaphragm 236 can be attached to the body plate 238 by a suitable diaphragm attaching adhesive 237. The actuator section 230 can also include the piezoelectric actuator 239, operable as known in the art to output ink from the ink feed plate section 240 described in further detail below. The heater attach layer 231 can include an adhesive layer suitable for attaching to the heater layer 224 of the heater section 220.

The ink feed plate section 240 can include an outlet plate 242, and an aperture plate 244. The outlet plate 242 can be bonded to the aperture plate 244 with a suitable aperture plate adhesive layer 246 and the outlet plate 242 can be bonded to the body plate 238 of the actuator section 230 by a suitable outlet plate adhesive layer 248.

The various adhesive layers can be any appropriate adhesive, including but not limited to R1500 (a flexible assembly adhesive by Rogers Corporation) and Kapton® ELJ (a coated polyimide film produced by DuPont Corporation consisting of a Kapton® E core coated on each side with a layer of Kapton® LJ low temperature polyimide adhesive). The thicknesses of the adhesive layers can suitable for securing adjacent layers, for example at a thickness of about 1 or about 2 mils.

The sections 210, 220, 230, 240 and layers of the sections can be bonded together in a press at high temperature and pressure. The rock screen section 210 is positioned upstream of the three constrictions identified in FIG. 1. In general, ink passes through the rock screen section 210 prior to passing through each of the heater section 220, actuator section 230 and ink feed plate section 240 in order to protect the subsequent outlets and apertures from debris particles contained in the ink. If hole sizes of the rock screen section 210 are not small enough, then particles can pass through the rock screen section and interact with the downstream structure in ways that interfere with jetting.

Figure 3:
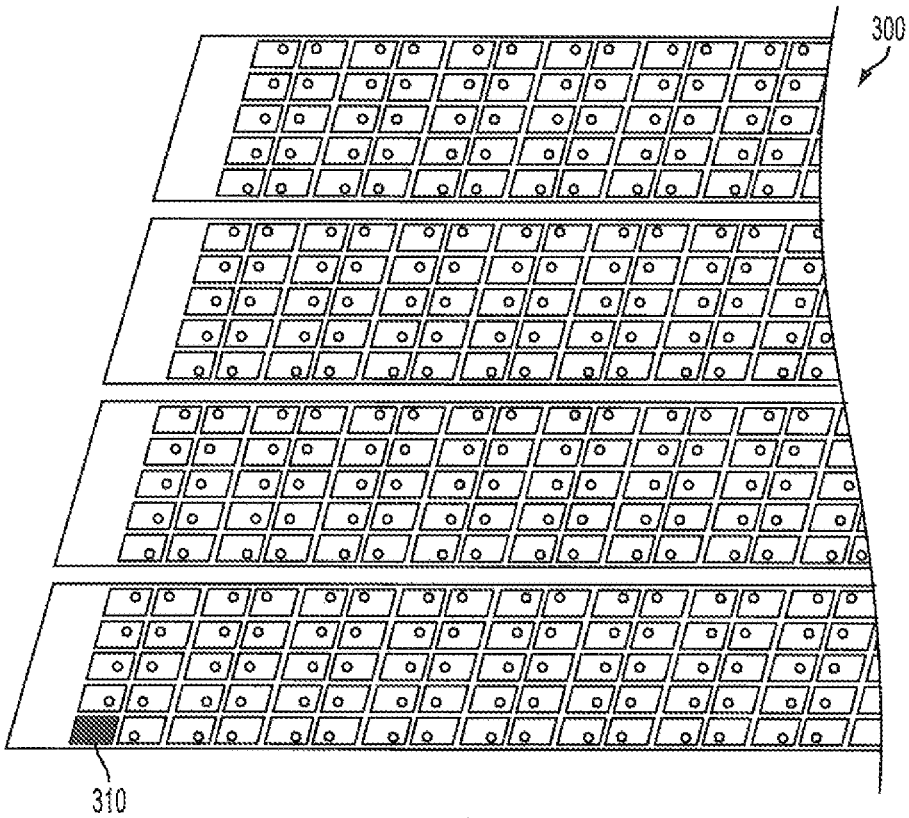
FIG. 3 is a perspective view of a layout of actuators on the front face of an ink-fed print head, in accordance with the present teachings.

FIG. 3 depicts an exemplary layout 300 of actuators on the front face of a print head (not shown). It should be readily apparent to one of ordinary skill in the art that the layout 300 depicted in FIG. 3 represents a generalized schematic illustration and that other components can be added or existing components can be removed or modified.

In the lower left of FIG. 3, designated area 310 is a patch corresponding to an allocated area of rock screen for a particular jet. For a given hole size and packing density, this patch of holes 310 has some fluidic resistance. Increasing the area of the rock screen will decrease the fluidic resistance. For example, by doubling the filter area, the resistance can be reduced by as much a half.

The development herein includes forming a laminate structure with rock screens on multiple planes, thereby increasing the effective area of rock screen. A laminate with N rock screen planes will have about N times more filtering area. This can allow the use of smaller rock screen holes which prevent problem particles from reaching the actuator, and in particular from reaching constrictions in the actuator. In the following, two rock screen planes are depicted and described for purposes of explanation only, and it will be appreciated that any number of rock screen planes in excess of two for a given structure can be used to practice the exemplary embodiments.

Figure 4:
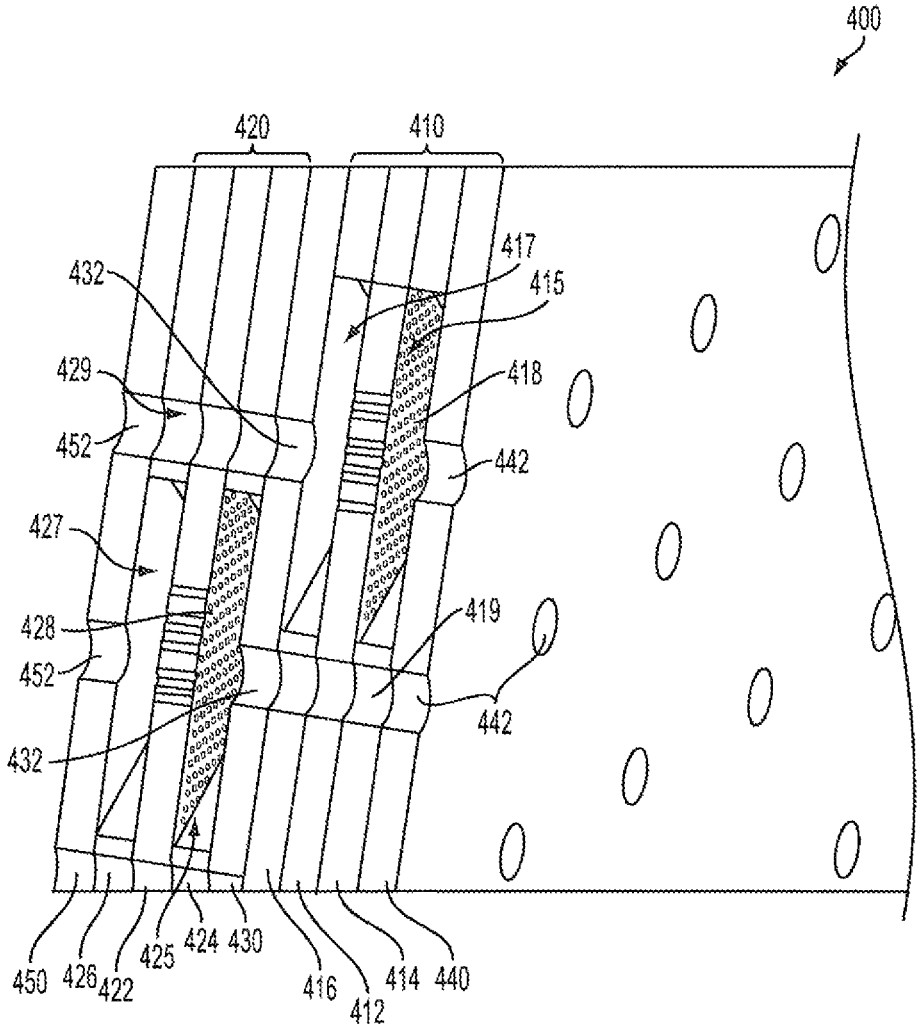
FIG. 4 is a perspective view of a multi-plane laminated filter structure for use in an imaging print head, in accordance with the present teachings.

FIG. 4 depicts an exemplary structure for a multi-plane filter laminate 400 in accordance with the present teachings. The multi-plane filter laminate 400 corresponds to the rock screen section 210 of FIG. 2. It should be readily apparent to one of ordinary skill in the art that the multi-plane filter laminate 400 depicted in FIG. 4 represents a generalized schematic illustration and that other components can be added or existing components can be removed or modified.

As shown in FIG. 4, the structure 400 can include a first rock screen sub-assembly 410 and a second rock screen sub-assembly 420. In accordance with the present teachings, first rock screen sub-assembly 410 and second rock screen subassembly 420 can form a fundamental basis unit such that a plurality of fundamental basis units can fill the entire printhead area with rock screen. In an exemplary embodiment, each rock screen subassembly of the fundamental basis unit can feed an individual jet. In another exemplary embodiment, a plurality of fundamental basis units can feed a manifold that then feeds the jets. A separating layer 430 can be positioned between the first and second rock screen subassemblies 410, 420, respectively. Ink feed plates 440, 450 can be formed on outer surfaces of the first and second rock screen subassemblies 410, 420, respectively.

In various embodiments, the first rock screen subassembly 410 can include a rock screen plate 412 sandwiched by an upstream pocket layer 414 and a downstream pocket layer 416. In certain embodiments, the upstream pocket layer 414 can be eliminated, with the ink supplied directly to the exposed rock screen plate 412. The upstream 414 and downstream 416 pocket layers can be aligned such that pocket areas 415, 417 thereof are configured to align on opposing sides of the rock screen plate 412. It will be appreciated that the terms "upstream" and "downstream" are relative to a direction of ink flow through the assembly 400. The rock screen plate 412 can include ink through-holes 418 over an entirety or substantially an entirety of its exposed surfaces between pocket areas 415 and 417.

In various embodiments, the second rock screen subassembly 420 can include a rock screen plate 422 sandwiched by an upstream pocket layer 424 and a downstream pocket layer 426. The upstream pocket layer 424 and the downstream pocket layer 426 can be aligned such that pocket areas 425, 427 thereof are configured to align on opposing sides of the rock screen plate 422. As with the first rock screen subassembly 410, pocket area 425 can be considered an "upstream" pocket and pocket area 427 can be considered a "downstream" pocket. The rock screen plate 422 can include ink through-holes 428 over an entirety or substantially an entirety of its exposed surfaces between pocket areas 425 and 427.

As depicted in FIG. 4, the rock screen plate 412 of the first rock screen subassembly 410 will overlap the rock screen plate 422 of the second rock screen subassembly 420. This overlap increases the effective filtering surface area of the structure 400. It will be appreciated that although only two rock screen subassemblies are depicted, multiple rock screen subassemblies, and hence rock screen planes, can be implemented in a single structure. One of ordinary skill in the art will appreciate that multiple rock screen planes can be on the same geometric plane. A laminate with N rock screen planes can have about N times more filtering area. It will also be appreciated from the figures that the first rock screen plate 412 is on a different geometric plane than the second rock screen plate 422.

Each of the subassemblies 410, 420 can include ink feed through paths 419, 429, respectively. The feed through paths 419, 429, can be formed from aligned apertures (not individually numbered), in each of the layers of the subassemblies 410, 420. The ink feed through paths 419, 429 in the respective subassemblies 410, 420 align with apertures 442, 452 in the outer ink feed plates 440, 450 and with corresponding apertures 432 in the intermediate plate 430. Ink can be directed from an aperture 442 of the outer ink feed plate 440 to upstream pocket 415, through the first rock screen plate 412 to downstream pocket 417, and then out of an aperture 452 of the downstream ink feed plate 450 via the feed through path 429 of the subassembly 420. Likewise, the feed through path 419 can be configured such that ink can be directed through aperture 442 of the outer ink feed plate 440, through path 419 to upstream pocket 425 of subassembly 420, through the second rock screen plate 422 to the downstream pocket 427 of subassembly 420 and out of the downstream ink feed plate 450 through aperture 452 therein. Apertures 432 in the separating layer 430 are aligned with respective through paths 419 and 429 as shown.

In each rock screen plate layer 412 and 422, the holes 418 and 428, respectively, can have a diameter of about 10 to about 35 microns, and further the holes can have a diameter of about 5 to about 25 microns.

As indicated, separating layer 430 can be positioned between each of a pair of rock screen subassemblies 410, 420. The separating layer 430 can define an outer wall of the downstream pocket 417 of the first rock screen subassembly 410 and an outer wall of the upstream pocket 425 of the second rock screen subassembly 420. The separating layer 430 can include ink apertures 432 at predetermined locations across the separating layer 430. The ink apertures 432 of the separating layer 430 can be configured to direct fluid from the first rock screen subassembly 410 to the second rock screen subassembly 420 as shown.

The ink apertures and through holes of the various layers can be etched, drilled, or otherwise formed through the layers of each subassembly. It will be appreciated, that each rock screen subassembly 410, 420 can feed an individual actuator or a common manifold of a liquid ink device.

The ink feed plates 440, 450, rock screen subassemblies 410, 420, and separating layer 430 can be adhesively bonded together using heat and/or pressure.

The rock screen plates 412, 422 can be formed of a laser ablated polyimide screen. The subassemblies 410, 420 can be formed using standard laser micro-machining techniques of films such as polyimide and R1500 adhesive which are then bonded together in a press at high pressure and temperature. The layers can be formed using thin films of polymer or metal sheet. Adhesives, thermoplastics or brazing in the case of metals can be used to bond the layers together. This approach also allows the use of smaller rock screen holes which prevent problem particles from reaching the actuator.

It will be appreciated that the structure 400 can be incorporated into an ink marking device in a location consistent with configurations having a single rock screen layer. The multi-plane filter laminate herein will include advantages over prior known ink printing devices as described above.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A printhead comprising:

a fluid inlet; and a jetstack configured to include a multi-plane filter laminate, the multi-plane filter laminate comprising:

a first rock screen subassembly comprising a first downstream pocket layer and a first rock screen plate disposed between the fluid inlet and the first downstream pocket layer, wherein the first rock screen plate comprises a first plurality of through holes; and a second rock screen subassembly bonded to the first rock screen subassembly comprising a second upstream pocket layer, a second downstream pocket layer aligned with the second upstream pocket layer, and a second rock screen plate sandwiched between the second upstream and second downstream pocket layers, wherein the second rock screen plate comprises a second plurality of holes, a portion of the first rock screen plate of the first subassembly, overlaying the second rock screen plate of the second subassembly, wherein the first rock screen subassembly does not comprise a first upstream Docket layer.

2. The printhead of claim 1, further comprising a fluid outlet, wherein the fluid inlet is configured to directly supply fluid to the first rock screen plate and the fluid outlet is configured to direct fluid from the first downstream pocket layer.

3. The printhead of claim 1, wherein each rock screen plane is configured to feed an individual actuator.

4. The printhead of claim 1, wherein each rock screen plate comprises a laser ablated polyimide screen.

5. The printhead of claim 1, wherein each rock screen plate comprises holes having a diameter of about 10 to about 35 microns.

6. The printhead of claim 1, wherein each filter layer comprises holes having a diameter of about 5 to about 25 microns.

7. The printhead of claim 1, further comprising a separating layer between and bonded to adjacent subassemblies.

8. A laminated rock screen structure for a liquid ink print head, the rock screen structure comprising:

a fluid inlet:

a first rock screen subassembly comprising a first downstream pocket layer and a first rock screen plate disposed between the fluid inlet and the first downstream pocket layer, the first rock screen plate configured with through holes over an entire exposed surface area thereof; and a second rock screen subassembly bonded to the first rock screen subassembly, the second rock screen subassembly comprising a second upstream pocket layer, a second downstream pocket layer aligned with the second upstream pocket layer, and a second rock screen plate sandwiched between the second upstream and second downstream pocket layers, the second rock screen plate configured with through holes over an entire exposed surface area thereof, a portion of the first rock screen plate of the first subassembly laterally offset from and overlaying the second rock screen plate of the second subassembly, wherein the first rock screen subassembly does not comprise a first upstream pocket layer.

9. The structure of claim 8, further comprising a fluid outlet, wherein the fluid inlet is configured to directly supply fluid to the first rock screen plate and the fluid outlet is configured to direct fluid from the first downstream pocket layer.

10. The structure of claim 8, wherein the first rock screen plate is configured to feed a first actuator and the second rock screen plate is configured to feed a second actuator.

11. The structure of claim 8, wherein each of the first and second rock screen plates comprise a laser ablated polyimide screen.

12. The structure of claim 8, wherein each of the first and second rock screen plates comprises holes having a diameter of about 10 to about 35 microns.

13. The structure of claim 8, wherein each of the first and second rock screen plates comprise holes having a diameter of about 5 to about 25 microns.

14. The structure of claim 8, further comprising a separating layer between and bonded to adjacent subassemblies.

15. A printhead stack for a liquid ink printer, the printhead stack comprising:

a manifold assembly, the manifold assembly comprising a multi-plane filter laminate;

a heater assembly;

an actuator assembly;

an aperture plate; and a fluid inlet, wherein the printhead stack is configured to filter ink at the multi-plane filter laminate and dispense filtered ink at the aperture plate, wherein the multi-plane filter laminate comprises:

a first rock screen subassembly configured to include a downstream pocket layer and a rock screen plate disposed between the fluid inlet and downstream pocket layer, the rock screen plate configured with through holes over an entire exposed surface area thereof;

a second rock screen subassembly bonded to the first rock screen subassembly and configured to include an upstream pocket layer, a downstream pocket layer aligned with the upstream pocket layer, and a rock screen plate sandwiched between the upstream and downstream pocket layers, the rock screen plate configured with through holes over an entire exposed surface area thereof; and a separating layer bonded between adjacent rock screen subassemblies;

a portion of the filter layer of the first rock screen plate laterally offset from and overlaying the filter layer of the second rock screen plate, wherein the fluid inlet is configured to directly supply fluid to the first rock screen subassembly.

16. The printhead stack of claim 15, further comprising a fluid inlet configured to direct fluid to the first rock screen subassembly and a fluid outlet to direct fluid from the downstream pocket layer for each subassembly.

17. The printhead stack of claim 15, wherein each rock screen plate is configured to feed an individual actuator.

* * * * *